US005917404A

United States Patent [19]

Campbell

[11] Patent Number: 5,917,404

[45] Date of Patent: Jun. 29, 1999

[54] POWER RESISTOR

[75] Inventor: John S Campbell, Mississauga, Canada

[73] Assignee: IPC Resistors, Inc., Ontario, Canada

[21] Appl. No.: 08/782,624

[22] Filed: Jan. 13, 1997

[51] Int. Cl.[6] ..... H01C 1/01

[52] U.S. Cl. ..... 338/315

[58] Field of Search ..... 338/204–210, 338/230, 244, 251, 252, 278–280, 315–319, 283, 284, 293, 294, 290, 53, 58

[56] References Cited

U.S. PATENT DOCUMENTS

| | | | |
|---|---|---|---|
| 1,972,499 | 9/1934 | Tarpley et al. | 201/63 |
| 2,396,099 | 3/1946 | Hartwell et al. | 201/63 |
| 4,052,588 | 10/1977 | Nakamura et al. | 219/345 |
| 4,630,024 | 12/1986 | Allen et al. | 338/58 |
| 4,935,687 | 6/1990 | Ton-That et al. | 219/376 |
| 5,281,944 | 1/1994 | Kirilloff et al. | 338/280 |
| 5,304,978 | 4/1994 | Cummins et al. | 338/280 |

OTHER PUBLICATIONS

Avtron Edgewound Resistors, http://www.avtron.com/aer.htm , (216) 641–8310, Dec. 12, 1997.

*Primary Examiner*—Teresa Walberg
*Assistant Examiner*—Jeffrey Pwu
*Attorney, Agent, or Firm*—Cesari and McKenna, LLP

[57] ABSTRACT

An improved power resistor includes a resistive element extending between a first electrical connection terminal and a second electrical connection terminal. The resistive element has a plurality of first insulating regions, arranged along its length extending generally parallel to each other in a first row. The resistive element further has a plurality of second insulating regions arranged generally parallel to each other in a second row. The first and second rows are further arranged generally parallel to each other so that each of the second insulating regions extends between two of the first insulating regions. The first and second insulating regions thereby define a tortuous current path from the first terminal to the second terminal. This tortuous path creates a current path between the terminals having increased resistance. The insulating regions are preferably interleaved chevrons and are preferably formed by stamping out portions of a resistive slab, made of steel or the like. The slab may be rolled or bent to form part of a resistor assembly.

29 Claims, 6 Drawing Sheets

POWER RESISTOR

FIELD OF THE INVENTION

The present invention relates to electrical resistors, and more particularly to electrical resistors used in high power applications.

BACKGROUND OF THE INVENTION

High power electrical resistors are known and used in many applications. For example, power resistors are used by heavy industry and electrical utilities as neutral grounding resistors; damping resistors; in harmonic filters; in speed controls; for motor starting; and the like.

Known power resistors may take the form of an edge-wound conductor mounted on a insulating core. For example one such resistor is formed by winding a steel strip about the edge of a ceramic core. Alternatively, insulated wire conductor mounted about an insulating core forms a wire wrapped resistor.

Other power resistors take the form of a solid conductive ribbon, having a current path from end to end. The ribbon is bent in an accordion-like shape to reduce the size of the resistor while maintaining the relatively long current conducting path. Further known resistors are made of a plurality of stamped grids connected in series, or of a helical wire wrapped about a cylindrical core.

As is well known and understood, the resistance of a resistor is directly proportional to the effective length of the conductive element used to form the resistor. The resistance of the known power resistors is thus limited by the length of conductive material used to form the resistor.

One further known design incorporates a resistive slab having a plurality of circular holes or slots. These circular holes create a non-linear current path along the resistor, and provide for improved heat transfer and ventilation of the resistor. However, the choice of arrangements of circular holes does not provide for an optimum resistance.

It is an object of the present invention to provide an improved power resistor that overcomes some of the disadvantages of known devices.

SUMMARY OF THE INVENTION

In accordance with one aspect of the present invention, there is provided, a power resistor comprising a first electrical connection terminal and a second electrical connection terminal; a resistive element extending between said first terminal and said second terminal said element having, a plurality of first insulating regions, extending generally parallel to each other along said element arranged in a first row along said element; each of said insulating regions having a first orientation in said row, and each of said regions having a first shape, said shape being asymmetric about an axis transverse to said first row; a plurality of second insulating regions, having generally said first shape and an orientation substantially opposite said first orientation; said second regions extending generally parallel to each other arranged in a second row, said second row arranged generally parallel to said first row along said element, each said second insulating region extending between two of said first insulating regions; whereby said first and second insulating regions define a tortuous current path from said first terminal to said second terminal.

In accordance with another aspect of the present invention, there is provided a power resistor comprising a first electrical connection terminal and a second electrical connection terminal; a resistive element extending between said first terminal and said second terminal, said resistive element having a plurality of first insulating regions, each first insulating region having a central portion with two wings, one wing extending from either side of said central region such that a tip of each wing is more proximate said first terminal, in a direction extending along said element, than is said central portion; a plurality of second insulating regions, each second insulating region having a central portion with two wings, one wing extending from either side of said central region such that a tip of each wing is more proximate said second terminal, in a direction extending along said element than is said central portion; for each first insulating region, one wing of each of two second insulating regions extends between the wings of the first insulating region, whereby said first and second insulating regions define tortuous current paths from said first terminal to said second terminal.

BRIEF DESCRIPTION OF THE DRAWINGS

In drawings which illustrate embodiments of the invention.

DETAILED DESCRIPTION OF THE PREFERRED EMBODIMENTS

Figure 1:
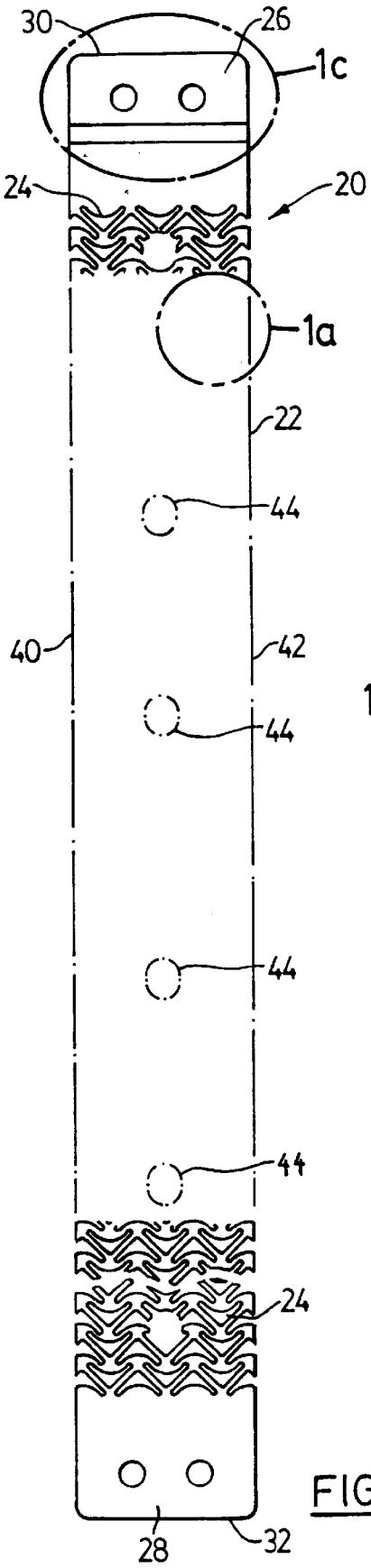
FIG. 1 is a resistive slab forming part of a power resistor in accordance with one aspect of the present invention.

With reference to FIG. 1, a power resistor 20 comprises a resistive element in the nature of resistive slab 22 having a plurality of insulating regions 24. Resistive slab 22 is made of a conducting material such as steel (grey painted, mill galvanized or stainless, for example), aluminum or other metal; carbon; or a suitable alloy. The slab has a length (l) and generally uniform width (w) and thickness (t). Terminal connection points 26 and 28 are located proximate ends 30 and 32 of slab 22.

Figure 1C:
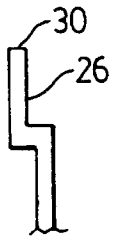
FIG. 1*c* is a side plan view of a portion of FIG. 1.
Figure 1A:
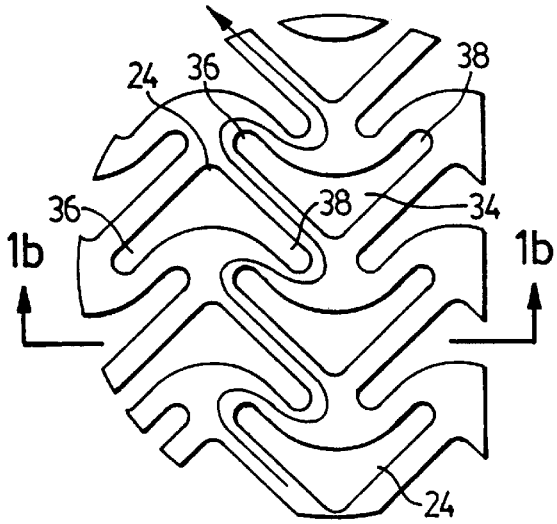
FIG. 1*a* is an enlarged view of a portion of FIG. 1.

As best illustrated in FIG. 1*a,* each insulating region 24 preferably has a generally chevron shape. Each chevron shape comprises a central portion 34 with two wings 36 and 38. Insulating regions 24 are formed by cutting or stamping out portions of the conductive material forming slab 22.

Thus, insulating regions 24 are actually air gaps in slab 22. The stamping allows for the inexpensive production of the power resistor 20, from a resistive slab 22 made of a single material.

Insulating regions 24 are arranged in generally parallel rows extending from proximate one end 30 of slab 22 to the other end 32. Each row comprises a plurality of chevron shaped regions having a generally parallel orientation, with wings 36 and 38 of each chevron in a row either extending from central portion 34 toward end 30 or extending from central portion 34 toward end 32. The central portions 34 of all chevron shaped regions in a row are generally aligned along an axis parallel to the sides 40, 42 of slab 22. Adjacent rows of chevron shaped regions are also generally parallel. The chevrons of adjacent rows have opposite orientations and are interleaved so that each wing of each chevrons in one row extends between two wings of chevrons in a neighbouring row (FIG. 1*a*). Additionally, a row of partial chevrons extends along each side 40 and 42 of slab 22, thereby making sides 40 and 42 jagged, and interrupting any direct current path from terminal 26 to terminal 28 along and proximate sides 40, 42.

End 30 of slab 22 is suitable for electrically connecting slab 22 to an identical slab 22 at its opposite, complementary end 32. End 30 is kinked slightly as illustrated in FIG. 1*c,* in order to receive a complementary end the further identical slab generally flush with the surface of of slab 22.

Slab 22 further comprises mounting holes 44, along its centre between sides 40 and 42 of slab 24 and at regular intervals along its length.

Figure 2:
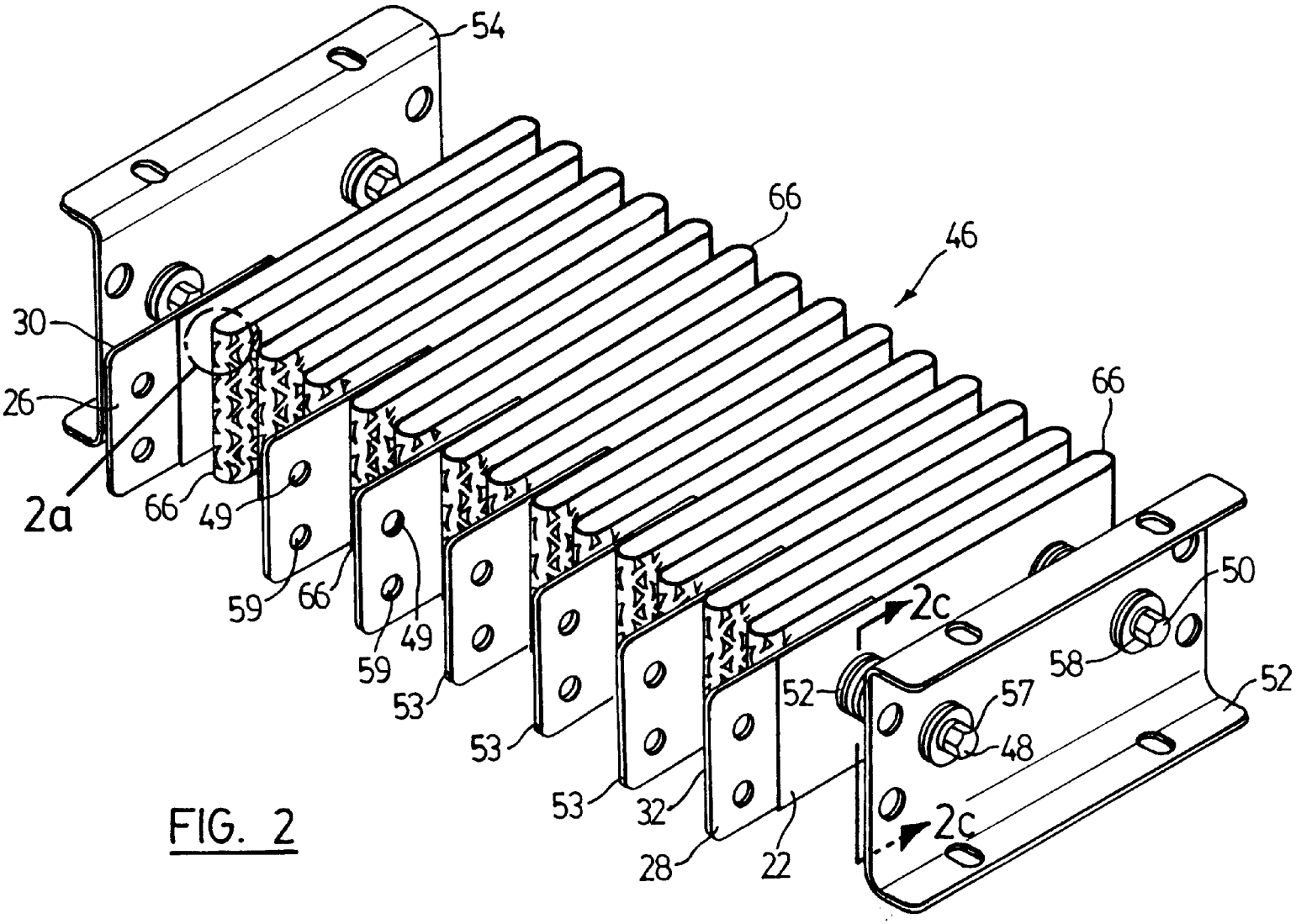
FIG. 2 is a ribbon resistor in accordance with another aspect of the present invention.
Figure 2A:
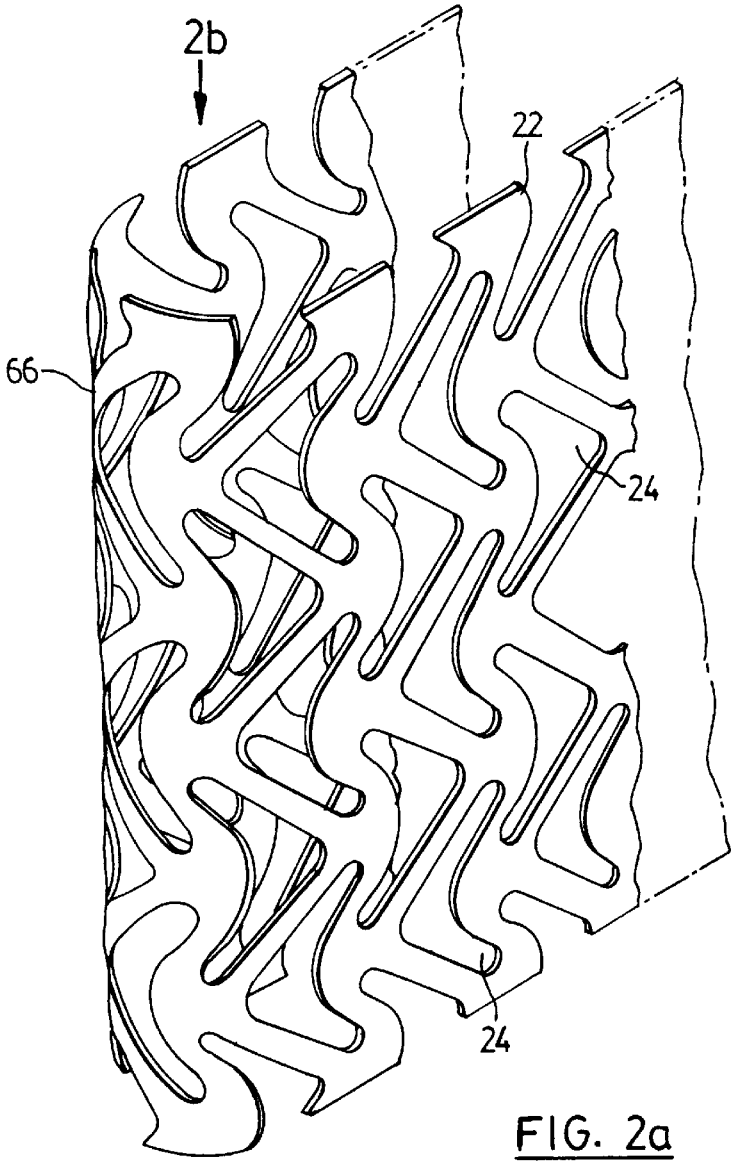
FIG. 2*a* is an enlarged view of a portion of FIG. 2.
Figure 2B:
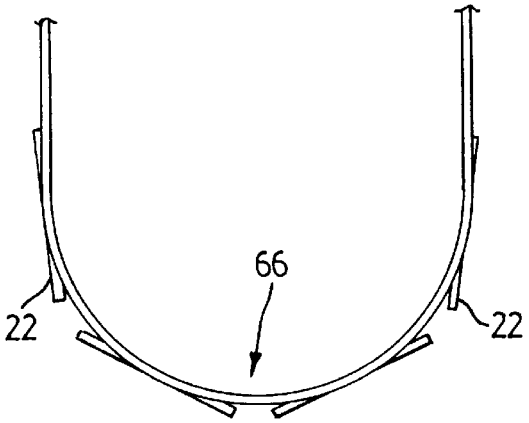
FIG. 2*b* is a top plan view of FIG. 2*a;*

As illustrated in FIG. 2, a plurality of slabs 22 may be interconnected at their ends (ie. end 30 of one slab to end 32 of another) and may be folded at regular intervals to form an accordion-like ribbon resistor assembly 46. The folded slabs 22 are mounted on rods 48 and 50, with each mounting hole 44 (FIG. 1) engaging a rod 48 or 50. Every other mounting hole (FIG. 1) engages one rod 48, while the remaining mounting holes engage a second rod 50. This folded arrangement allows slabs 22 almost thirty feet in length to be folded into a ribbon resistor assembly 46 slightly longer than two feet. Of course, if a single slab of thirty feet can be manufactured assuring for proper alignment of insulating regions 24, several slabs do not need to be attached end to end.

Figure 2C:
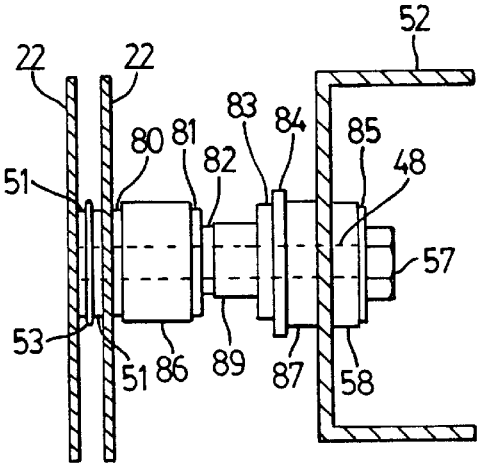
FIG. 2*c* is a cross-sectional view of FIG. 2*a,* taken along 2*c*—2*c;*

As shown in FIG. 2*c,* rod 48 has a circular cross-section and is made of a rigid conducting material. Two spacer washers 51 and an insulating washer 53 are used to keep each folded portion of slab 22 at a fixed distance from each adjacent folded portion. Spacer washers 51 are made of a conductive material, such as galvanized steel, but are spaced by thin insulating washer 53. Insulating washer 53 may be made of mica and prevents electrical contact between adjacent folded portions of slab 22. Proximate an end of rod 48, washers 80, 81, 82, 83 and 84; mica spacers 86 and 87; and nut 89; all space slab 22 from end plate 52. With reference to FIGS. 2 and 2*c,* rods 48 and 50 are threaded at their ends and bolted to end plates 52, 54 which act as mounts. Moreover, end plate 52 is attached to rod 48 by mica spacer 88; washer 85; and nut 57 (FIG. 2*c*). An identical arrangement is provided at each end of rod 48, and for rod 50.

Heavy terminal plates 53 (FIG. 2) are mechanically clamped and welded to slab 22 and feature a two hole 49, 57 industry standard NEMA bolt pattern. Terminal plates 53 act as electrical connection points to resistor element 46. Resistor assembly 46 may be formed in standard "Mill Bank" dimensions to insure interchangeability with existing power resistors.

Figure 3:
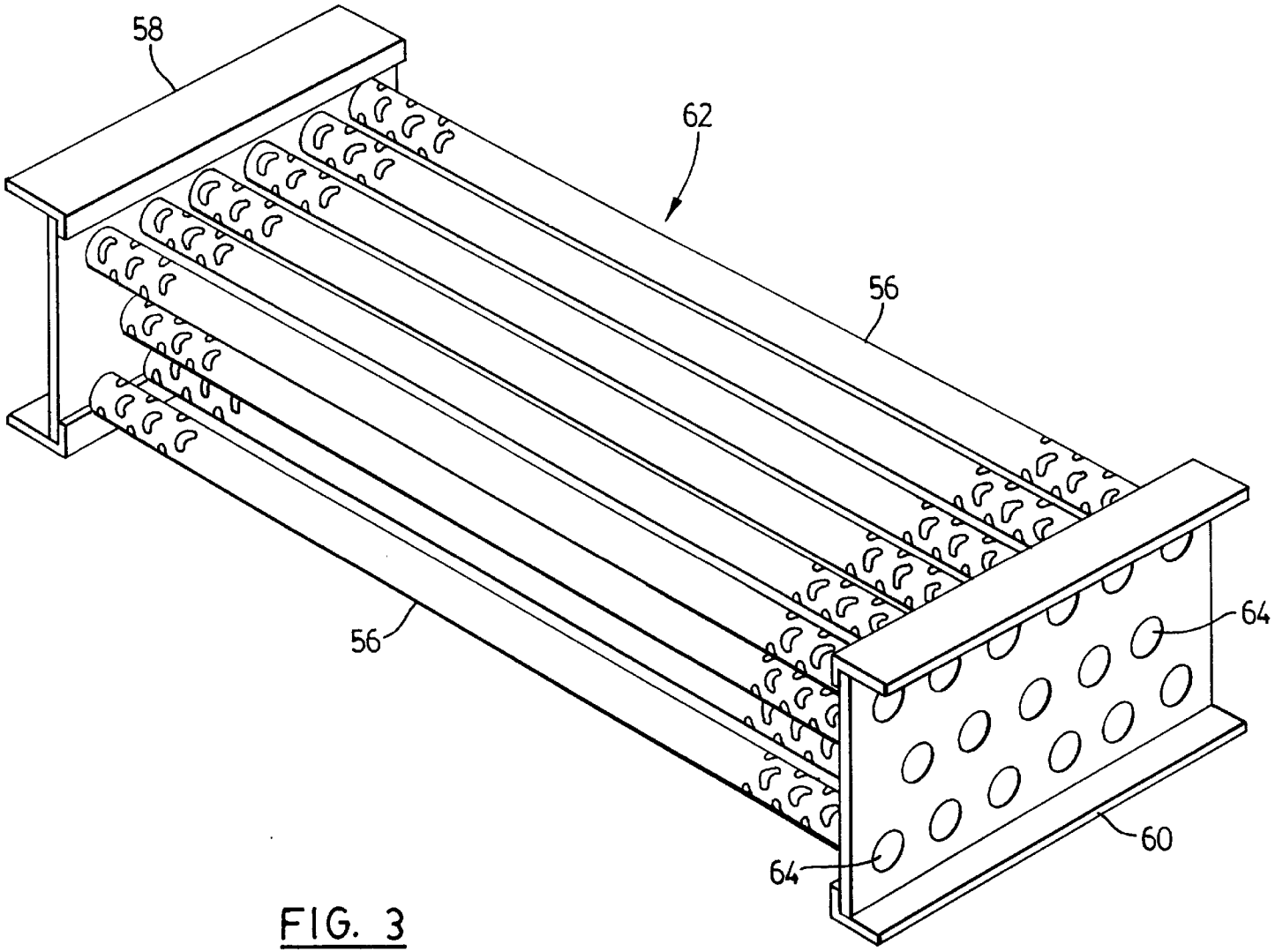
FIG. 3 is a bank of power resistors in accordance with an aspect of the present invention.

As illustrated in FIG. 3, a slab similar to slab 22 may also be rolled lengthwise to form a generally cylindrical resistive element 56. A plurality of cylindrical resistive elements 56 may be mounted on two end plates 58 and 60 to form a tubular resistor bank 62. End plates 58 and 60 are also formed of an insulating material. For the purpose of mounting cylindrical resistor elements 56, pins or bolts extending radially through the cylindrical resistor elements 56 keep the elements 56 mounted to end plates 58 and 60. These pins or bolts (not shown) may extend radially through cylindrical elements 56 on one or both sides of end plates 58 and 60. Similarly, end plates 58 and 60 have appropriate sized holes 64 for mounting a plurality of cylinders 56. The mounting holes 64, however, do not electrically connect cylindrical resistive elements 56 to end plates 58 and 60. Of course, these individual cylindrical resistive elements 56 may be connected in parallel or series depending on the required application. Electrical connection to the resistor bank 62 may be effected at terminals at the ends of cylindrical resistors 56 near end plates 58 and 60.

When an electric potential is applied to the terminals of resistor 20 of FIG. 1, resistor assembly 46 of FIG. 2 or resistor bank 62, FIG. 3, a current inversely proportional to the resistance of the resistive element between the terminals will flow between the terminals. Typically AC voltages from 120 V to 2 kV are applied.

Without insulating regions 24, the resistance of slab 22, for example, between its ends from which each resistive element is formed could easily be calculated as $$R=\rho\times\text{length of slab}/(\text{cross-sectional area of slab})$$

wherein $\rho$=resistivity per unit length of the conductive material used to form slab 22.

With the addition of insulating regions 24, however, current can no longer flow directly from one end of the slab 22 to the other. The arrangement of insulating regions 24 on the slab 22 creates a tortuous current path between terminals 26 and 28. Thus, instead of flowing directly from one end to the other, current must flow between regions 24 in a generally zig-zag path which, for resistor 20, is illustrated in FIG. 1*a.* Thus, the length of the effective current path between terminals 26 and 28 is significantly greater than length (l) of the slab 22, as the current will traverse the insulating regions. As the length of the current path is increased, so is the effective resistance of the slab between terminals 26 and 28.

Figure 1B:
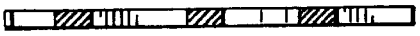
FIG. 1*b* is a cross-sectional plan view of FIG. 1*a,* along 1*b*—1*b;*

As illustrated in FIG. 1*b,* the cross-sectional area along the tortuous path is reduced from that of the entire slab to the cross-section of the portions between resistive regions 24, thus further increasing the resistance along this path.

Empirical evidence indicates that the resistance of resistive slab 22 is between ten and twenty times as great as the resistance of a known ribbon resistors. Known ribbon resistors have a resistance of approximately 0.05 ohms, while resistors of similar dimensions, as disclosed herein, have resistance measured at approximately 0.72 ohms.

Additionally, as will be appreciated, in typical applications a power resistor 20 must dissipate several kilowatts of electrical power, as heat. Thus, the temperature of the resistive element(s) may reach several hundred degrees celsius. As resistive regions 24 are air gaps, they facilitate heat transfer from the resistive element to the environment. Moreover, experiments shows that in the embodiment of FIG. 3 regions 66 near bends along the resistive element reach the highest temperatures. As shown in enlargement in FIGS. 3*a* and 3*b,* the chevron shaped insulating regions 24 coincidentally stretch and fan outwardly near these bends, thus providing for further improved heat transfer and cooling near bend regions 66.

As illustrated in FIG. 1*a,* the edges of insulating regions are preferably smoothed or rounded. This smoothing reduces the existence of eddy currents at or near cusps along the current paths which may be induced by AC currents flowing along the tortuous path along slab 22.

It will be appreciated that insulating regions 24 do not need to be chevron shaped nor have rounded edges, but may take other forms to create a tortuous path between connection points on the resistive element 22, so that the current along the path does not flow in one direction from one connection point to the other on the resistive element, in accordance with the invention.

Figure 4:
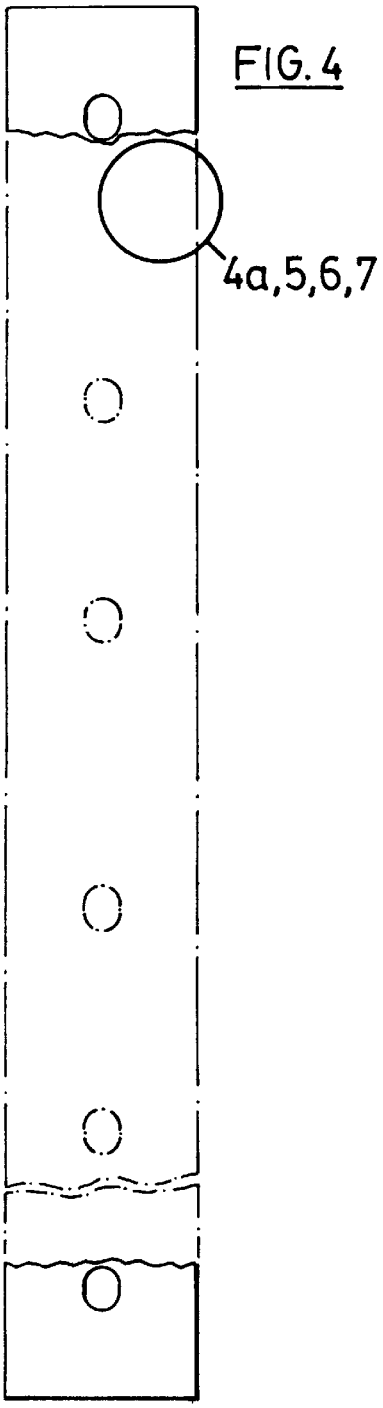
FIG. 4 is a resistive slab in accordance with a further aspect of the invention.
Figure 4A:
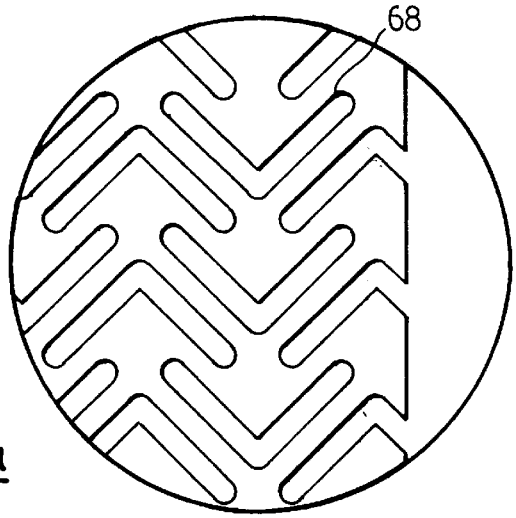
FIG. 4*a* is an enlarged view of insulating regions in accordance with a further aspect of the invention.
Figure 5:
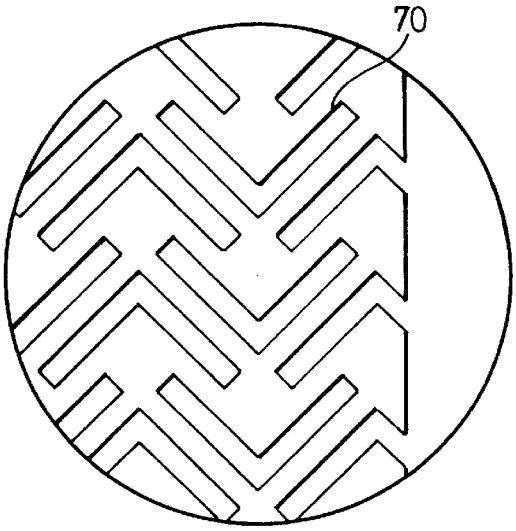
FIG. 5 is an enlarged view of insulating regions in accordance with a further aspect of the invention.

For example, FIGS. 4, 4*a* and 5 depict embodiments of the invention in which insulating regions are formed by chevron shaped cut-outs (68, 70) having minimally rounded edges (68 in FIG. 4*a*) or having straight edges and corners (70 in FIG. 5). Both these embodiments, employ the present invention but may not reduce the eddy currents as well as the embodiments of FIGS. 1–3.

Figure 6:
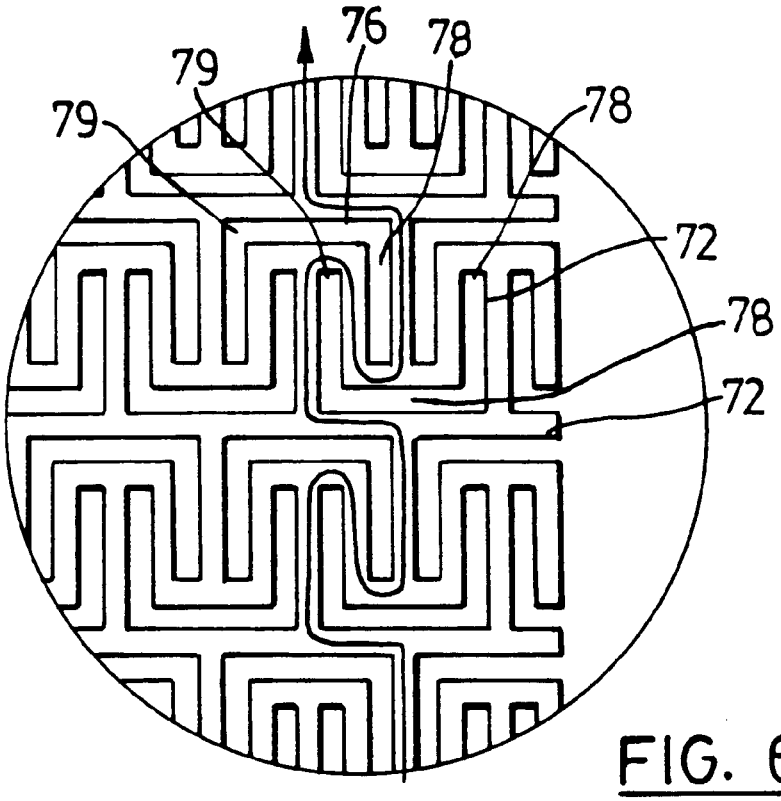
FIG. 6 is an enlarged view of insulating regions in accordance with a further aspect of the invention.
Figure 7:
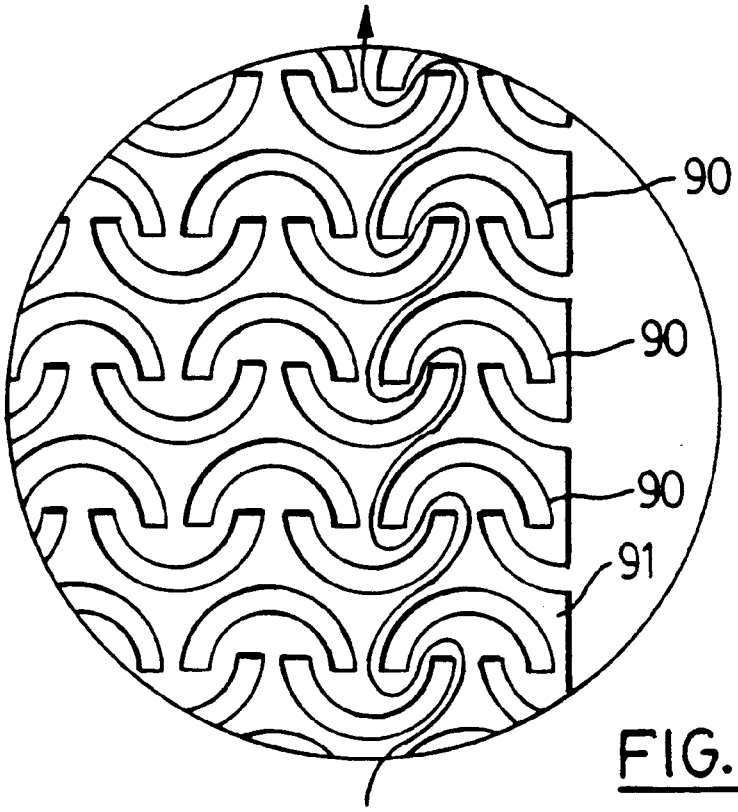
FIG. 7 is an enlarged view of insulating regions in accordance with a further aspect of the invention.

Similarly, as depicted in FIGS. 4, 6, and 7, the present invention does not require chevron shaped insulating regions. Instead, many different configurations having insulating regions arranged in generally parallel rows, each with wings and wings of adjacent rows arranged in an interleaved relationship will create a tortuous path as required.

For example, FIGS. 4*a* and 6 show another preferred embodiment of the invention, in which the insulating regions 72 comprise generally U-shaped cut-outs along slab 74. Each U shaped cut-out comprises a central portion 76 with two wings 78 and 79. U-shaped regions in one row are arranged convexly away from an end of the resistive element, while U-shaped regions in an adjacent row are arranged convexly toward that same end. These insulating regions 72 are arranged so that wings 78, 79 of one row of U-shaped cut-outs are interleaved between the wings 78, 79 of an adjacent row of U-shaped cut-outs thus defining a tortuous current path along the slab, as shown.

FIGS. 4*a* and 7 illustrate a further embodiment of the invention. Insulating regions 90, comprise generally semi-circular arcs. The semi-circular arcs are arranged in rows along the length of the slab, with adjacent rows of arcs having opposite orientation. Arcs in one row are arranged convexly away from an end of the resistive element, while arcs in an adjacent row are arranged convexly toward that same end. The arcs in adjacent rows are further interleaved so that each wing or tip of one arc rests between the wings or tips of an arc of an adjacent row of cut-outs.

Moreover, a person skilled in the art will readily realize that other modifications to the preferred embodiments are possible. For example, the insulating regions need not be air gaps but may be formed of other insulators such as glass or ceramics. The connection points to the resistor need not be at opposite ends of the resistor, but may be at points along the sides of resistive elements, as illustrated in FIG. 2.

A person skilled in the art will understand that the invention is not limited to the illustrations described and shown herein, which are deemed to be merely illustrative of the best modes of carrying out the invention, and which are susceptible to modification of form, arrangement of parts and details of operation. The invention, rather, is intended to encompass all such modifications which are within its spirit and scope as defined by the claims.

I claim:

1. A power resistor comprising:

a resistive element extending between first and, second contact points;

a first insulating region formed in said resistive element, said first insulating region having a central portion and first and second generally opposed wing portions extending away from said central portion;

a second insulating region formed in said resistive element having a first wing portion extending between said first and second generally opposed wing portions of said first insulating region;

said first and second insulating regions defining a tortuous current path along said resistive element, about said first and second insulating regions, from said first contact point to said second contact point.

2. A power resistor as claimed in claim 1, wherein said tortuous current path extends from said first contact point, toward said second contact point, back toward said first contact point, and toward said second contact point along said resistive element.

3. A power resistor as claimed in claim 2, wherein said second insulating region further comprises a central portion, and a second wing portion, and said first and second wing portions of said second insulating region extend from said central portion of said second insulating region and are generally opposed to each other;

and wherein one of said wing portions of said first insulating region extends between said first and second wing portions of said second insulating region.

4. A power resistor as claimed in claim 3, wherein said first and second contact points are on either side of said central portion of said first insulating region and said central portion of said second insulating region.

5. A power resistor as claimed in claim 2, wherein said first and second insulating regions are formed by cut-away portions extending through said element, located along said element.

6. A power resistor as claimed in claim 5, wherein said cut-away portions form holes through said element.

7. A power resistor as claimed in claim 6, wherein said first insulating region is generally chevron shaped, having an apex extending generally toward said first contact point.

8. A power resistor as claimed in claim 7, wherein said second insulating region is generally chevron shaped, having an apex extending generally away from said first contact point.

9. A power resistor as claimed in claim 8, wherein said chevron shaped cut-away portions have generally rounded cusps.

10. A power resistor as claimed in claim 9, wherein said element comprises a generally planar metal sheet.

11. A power resistor as claimed in claim 10, wherein said first and second contact points extend from opposite ends of said element.

12. A power resistor as claimed in claim 11, wherein said metal sheet is folded into an accordion-like shape.

13. A power resistor as claimed in claim 9, wherein said resistive element comprises a metal sheet rolled along its length to form a hollow right cylinder.

14. A power resistor as claimed in claim 6, wherein each of said first and second insulating regions has the shape of a generally semi-circular arc, said first region extending convexly toward said first contact point and said second region extending convexly away from said first contact point.

15. A power resistor as claimed in claim 6, wherein said first and second insulating regions are generally U-shaped, said first region extending convexly toward said first terminal and said second region extending convexly away from said first contact point.

16. The power resistor of claim 1 wherein at least one of said first and second insulating regions extends from an edge of said element.

17. a power resistor comprising:

a first electrical connection terminal and a second electrical connection terminal;

a resistive element extending between said first terminal and said second terminal, said resistive element having a plurality of first and second insulating regions, each first insulating region having a central portion with two generally opposed wings, one wing extending from either side of said central portion;

each second insulating region having a central portion with two generally opposed wings, one wing extending form either side of said central portion;

for each first insulating region, one wing of each of two second insulating regions extends between the generally opposed wings of the first insulating region, whereby said first and second insulating regions define tortuous current paths from said first terminal to said second terminal.

18. Power resistor as claimed in claim 17, wherein said first and second insulating regions are formed by cut-away portions extending through said element, located along said element.

19. Power resistor as claimed in claim 18, wherein said cut-away portions form holes through said element.

20. Power resistor as claimed in claim 19, wherein each of said first insulating regions is generally chevron shaped, having an apex extending generally toward said first terminal.

21. A power resistor as claimed in claim 20, wherein each of said second insulating regions is generally chevron shaped, having an apex extending generally away from said first terminal.

22. A power resistor as claimed in claim 21, wherein said chevron shaped cut-away portions have generally rounded cusps.

23. Power resistor as claimed in claim 22, wherein said element comprises a generally planar metal sheet.

24. A power resistor as claimed in claim 23, wherein said first and second connection terminals extend from opposite ends of said element.

25. A power resistor as claimed in claim 23, wherein said metal sheet is folded into a generally accordion-like shape.

26. A power resistor as claimed in claim 22, wherein said resistive element comprises a metal sheet rolled along its length to form a hollow right cylinder.

27. A power resistor as claimed in claim 19, wherein each of said first and second insulating regions is generally U-shaped, each said first region extending convexly toward said first terminal and each said second region extending convexly away from said first terminal.

28. A power resistor as claimed in claim 19, wherein each of said first and second insulating regions has the shape of a generally semi-circular arc, each said first region extending convexly toward said first terminal and each said second region extending convexly away from said first terminal.

29. The power resistor of claim 14, wherein at least one of said plurality of first insulating regions and said plurality of second insulating regions extends from an edge of said element.

* * * * *

UNITED STATES PATENT AND TRADEMARK OFFICE

CERTIFICATE OF CORRECTION

PATENT NO. : 5,917,404

DATED : June 29, 1999

INVENTOR(S) : John S. Campbell

It is certified that error appears in the above-identified patent and that said Letters Patent is hereby corrected as shown below:

On the cover page, [54], replace "POWER RESISTOR" with --POWER RESISTOR HAVING INSULATION REGIONS DEFINING A TORTUOUS CURRENT PATH--

In column 1, line 1, replace "POWER RESISTOR" with --POWER RESISTOR HAVING INSULATION REGIONS DEFINING A TORTUOUS CURRENT PATH--

In claim 1, line 2, insert --,-- after "element", delete "," after "and"

In claim 15, line 3, replace "terminal" with --contact point--

In claim 17, line 1, replace "a" with --A--

In claim 18, line 1, replace "Power" with --A power--

In claim 19, line 1, replace "Power" with --A power--

In claim 20, line 1, replace "Power" with --A power--

UNITED STATES PATENT AND TRADEMARK OFFICE

CERTIFICATE OF CORRECTION

PATENT NO. : 5,917,404

DATED : June 29, 1999

INVENTOR(S) : John S. Campbell

It is certified that error appears in the above-identified patent and that said Letters Patent is hereby corrected as shown below:

In claim 23, line 1, replace "Power" with --A power--

In claim 29, line 1, replace "claim 14" with --claim 17--

Signed and Sealed this

Twentieth Day of June, 2000

*Attest:*

Q. TODD DICKINSON

*Attesting Officer*

*Director of Patents and Trademarks*